US007721850B2

(12) United States Patent
Coble

(10) Patent No.: US 7,721,850 B2
(45) Date of Patent: May 25, 2010

(54) PERMANENTLY-INSTALLED WHEEL CHAIR LIFT WITH HEIGHT CONTROL

(75) Inventor: James T. (Tim) Coble, Tucson, AZ (US)

(73) Assignee: AGM Container Controls, Inc., Tucson, AZ (US)

( * ) Notice: Subject to any disclaimer, the term of this patent is extended or adjusted under 35 U.S.C. 154(b) by 75 days.

(21) Appl. No.: 11/818,618

(22) Filed: Jun. 14, 2007

(65) Prior Publication Data

US 2008/0308357 A1 Dec. 18, 2008

(51) Int. Cl.
*B66B 9/04* (2006.01)

(52) U.S. Cl. ..... 187/200; 187/276; 187/285; 414/921

(58) Field of Classification Search ..... 187/200, 187/272, 277, 285; 414/921
See application file for complete search history.

(56) References Cited

U.S. PATENT DOCUMENTS

| | | | | | |
|---|---|---|---|---|---|
| 2,514,314 | A | * | 7/1950 | Denton | 74/89.14 |
| 3,341,760 | A | * | 9/1967 | Fry | 318/469 |
| 3,524,563 | A | | 5/1968 | McCartney et al. | |
| 3,522,925 | A | * | 8/1970 | Buchtel | 248/371 |
| 3,785,462 | A | * | 1/1974 | Coad et al. | 187/262 |
| 3,888,463 | A | | 6/1975 | O'Brien | |
| 3,092,573 | A | | 9/1975 | Grove et al. | |
| 4,173,268 | A | * | 11/1979 | Nussbaum | 187/209 |
| 4,176,732 | A | | 12/1979 | Nordskog | 187/9 |
| 4,457,402 | A | | 7/1984 | Del Vecchio et al. | 187/12 |
| 4,466,771 | A | | 8/1984 | Thorley et al. | 414/787 |
| 4,488,326 | A | | 12/1984 | Cherry | |
| 4,556,128 | A | | 12/1985 | Thorley et al. | 187/90 |
| 4,576,539 | A | | 3/1986 | Williams | 414/391 |
| 4,785,915 | A | | 11/1988 | Shah et al. | 187/110 |
| 4,941,797 | A | * | 7/1990 | Smillie, III | 414/462 |
| 4,971,178 | A | | 11/1990 | Schauder et al. | 187/117 |
| RE33,595 | E | | 5/1991 | Sullivan | |

(Continued)

FOREIGN PATENT DOCUMENTS

| | | |
|---|---|---|
| GB | 1502921 | 3/1978 |

(Continued)

OTHER PUBLICATIONS

"Ascension Portable Wheelchair Lift" brochure, published by AGM Container Controls, Inc., And describing Models SLA-2050ED and SLA-2050ESD, both offered for sale in the United States by Dec. 2003.

*Primary Examiner*—Thomas J. Brahan
(74) *Attorney, Agent, or Firm*—Cahill Glazer PLC

(57) ABSTRACT

A height control mechanism for a lift device includes an elongated rail and an actuator slidingly mounted thereto. The actuator is biased toward a first end of the rail, and a proximity sensor is mounted proximate the second end of the rail. A cable pulls the actuator toward the second end of the rail as the lift device is elevated. When the proximity sensor detects the presence of the actuator, a signal is generated to halt further elevation. The position of the proximity sensor along the rail can be adjusted to set the maximum height of the lift device. A second proximity sensor, responsive to the presence of the actuator, can also be secured to the rail to generate a signal indicating that the lift device has been elevated off of the ground by a short distance.

5 Claims, 13 Drawing Sheets

U.S. PATENT DOCUMENTS

| | | | | |
|---|---|---|---|---|
| 5,040,936 | A | 8/1991 | Rhea | 414/540 |
| 5,046,585 | A | 9/1991 | Ohta et al. | |
| 5,105,915 | A | 4/1992 | Gary | 187/18 |
| 5,154,569 | A | 10/1992 | Eryou et al. | 414/495 |
| 5,205,697 | A | 4/1993 | Getty et al. | 414/341 |
| 5,322,408 | A | 6/1994 | Wooden | 414/495 |
| 5,346,355 | A * | 9/1994 | Riemer | 414/542 |
| 5,433,581 | A | 7/1995 | Farsai | |
| 5,476,155 | A | 12/1995 | Nakatani et al. | 187/202 |
| 5,499,694 | A | 3/1996 | Dom | 187/200 |
| 5,513,943 | A | 5/1996 | Lugash et al. | |
| 5,595,470 | A | 1/1997 | Berkey et al. | 414/495 |
| 5,941,347 | A | 8/1999 | Pfleger et al. | |
| 5,947,231 | A | 9/1999 | Raab et al. | 187/200 |
| 6,062,809 | A | 5/2000 | Berkey et al. | 414/809 |
| 6,086,314 | A | 7/2000 | Savaria | |
| 6,109,395 | A | 8/2000 | Storm | 187/200 |
| 6,182,798 | B1 | 2/2001 | Brady et al. | 187/282 |
| 6,203,266 | B1 | 3/2001 | Savaria et al. | 414/546 |
| 6,345,694 | B1 | 2/2002 | Volker | 187/223 |
| 6,419,050 | B1 | 7/2002 | Sardonico | 187/244 |
| 6,435,804 | B1 | 8/2002 | Hutchins | |
| 6,516,478 | B2 * | 2/2003 | Cook et al. | 5/611 |
| 6,601,677 | B1 | 8/2003 | Storm | 187/200 |
| 2003/0213653 | A1 | 11/2003 | Morris | |
| 2006/0182570 | A1 | 8/2006 | Zuercher et al. | |

FOREIGN PATENT DOCUMENTS

| | | |
|---|---|---|
| WO | WO 2006/072013 | 7/2006 |

* cited by examiner

PERMANENTLY-INSTALLED WHEEL CHAIR LIFT WITH HEIGHT CONTROL

BACKGROUND OF THE INVENTION

1. Field of the Invention

The present invention relates generally to lifting devices, and more particularly, to a permanently-installed wheelchair lift device with an improved height control mechanism to provide access to stages, platforms, risers and other elevated structures for individuals with disabilities.

2. Description of the Background Art

Under the Americans With Disabilities Act of 1990 (the "ADA"), the U.S. government required that public buildings be accessible to the disabled. For persons requiring a wheelchair for mobility, abrupt changes in floor elevation have to be modified to enable access by wheelchair. The ADA permits vertical lifting devices to be used instead of a ramp.

Lifting devices for the disabled are known in the prior art. For example, U.S. Pat. No. 5,105,915 (Gary) describes a lifting device having a car including fixed sides and short, one-piece ramps at each end. The car is raised and lowered by a pantograph jack including a hydraulic pump driven by an electric motor controlled by switches. The patent also describes several lifting devices of the prior art. Another wheelchair lifting device is disclosed in U.S. Pat. No. 6,182,798 to Brady, et al., and assigned to AGM Container Controls, Inc., the assignee of the present invention. The '798 patent discloses a portable lift device with gates at both ends of the lift car, transparent walls, a loading ramp, a dock plate, a stage height sensor, and numerous safety features. On the other hand, the height detection system disclosed in this patent involves mechanical contact between the lift car and a sensor positioned on the stage.

Another portable lifting device adapted for wheelchairs is disclosed within pending U.S. patent application Ser. No. 11/026,863, filed on Dec. 30, 2004, and published as U.S. Publ. No. 20060182570 (Zuercher, et al.) on Aug. 17, 2006, also assigned to the assignee of the present application. This application discloses a height adjustment mechanism accessible through a panel of the lift car for varying the elevational height of the lift. A rotatable arm is used to set the elevational height, and a knob secured to the end of such rotatable arm slides within a circular slot. The knob can be loosened to move the knob within the circular slot, thereby repositioning the rotatable arm. Once the knob is set to the desired elevational height, the knob is re-tightened, and the access panel is closed.

Portable wheelchair lifting devices generally require that the height to which the lift car is elevated be readily adjustable. Such lift devices are frequently moved from one stage or platform to another, and the elevations of two or more stages or platforms often differ from one another. On the other hand, a permanently-installed wheelchair lift remains permanently at a particular location, and once the height has been properly adjusted for a particular platform or stage, further height adjustments are neither required or recommended. During installation of a permanently-installed wheelchair lift, an installer adjusts the height to which the lift is elevated, and it would be desirable to permit such initial height adjustment to be made quickly and easily. Once the installer has adjusted the lift height, the lift device should be able to raise the platform of the lift device repeatedly, and reliably, to the pre-set height.

Lift devices for the disabled often include an entry gate and an exit gate. The entry gate is opened when the lift platform is fully-lowered to allow a user to enter the lift device prior to elevation, or to exit the lift device just after the platform is lowered. A valuable safety feature incorporated within lift devices for the disabled prevents the entry gate from being unlocked unless the platform is within a few inches of its fully-lowered position. Alternatively, the lift device can be configured to prevent continued elevation of the platform if the entry gate is not fully closed and locked by the time that the platform has been raised more than a few inches off the ground. To provide such safety features, it is necessary to sense that the platform is more than one or two inches above the ground.

In view of the foregoing, it is an object of the present invention to provide a lift device suitable for lifting wheelchair-bound users up to the height of stages, platforms, risers and the like in a safe and reliable manner, and comporting with all applicable ADA requirements.

Another object of the present invention is to provide such a lift device including a height control mechanism that does not require any physical contact between the lift device and the stage (or any objects supported by the stage).

A further object of the present invention is to provide such a lift device including a height control mechanism particularly adapted for a permanently-installed wheelchair lift that remains permanently at a particular location, and which reliably raises the lift platform to the same desired height time after time.

Yet another object of the present invention is to provide such a lift device including a height control mechanism for a permanently-installed lift wherein an installer can adjust the height to which the lift is elevated quickly and easily.

A still further object of the present invention is to provide such a lift device including a height control mechanism which can also be used to detect whether the lift platform is more than one or two inches above the ground.

These and other objects of the present invention will become more apparent to those skilled in the art as the description of the present invention proceeds.

SUMMARY OF THE INVENTION

Briefly described, and in accordance with one aspect thereof, the present invention relates to a height adjustment mechanism for a lift device used to provide access to a stage, platform, or the like for individuals with disabilities, including persons who rely upon wheelchairs or crutches to move about. The lift device includes a base, a movable lift car, and a lifting mechanism that selectively elevates the lift car relative to the base from a lowered position to an elevated position. The height adjustment mechanism controls the maximum height to which the lift car can be elevated so as to properly align with the stage, platform, etc.

The height adjustment mechanism includes a rail that extends between first and second opposing ends; the rail preferably extends generally horizontal. An actuator is supported for movement along the rail generally between the first and second ends of the rail. Preferably, the rail is made of metal, and the actuator is made of a durable plastic, e.g., machined nylon. The actuator is initially disposed generally proximate to the first end of the rail when the lift car is in its lowered position, and is biased away from the second end of the rail. Preferably, the height adjustment mechanism includes a biasing member for biasing the actuator away from the second end of the rail; this biasing member may be in the form of a spring, such as a constant force spring.

An elongated flexible member, preferably a braided wire cable, has a first end coupled to the actuator; the opposing second end of the flexible member is coupled to an anchor point. As the lift car is elevated, the flexible member urges the actuator toward the second end of the rail. Preferably, the rail is mounted to the lift car, so that the rail is elevated and lowered in accordance with the raising and lowering of the lift car; in this case, the anchor point is preferably a relatively fixed point, such as the base.

Alternatively, the anchor point may be secured to a lower portion of the lifting mechanism itself. For example, the lifting mechanism preferably includes a hydraulic lift cylinder having an extendable piston rod projecting therefrom. Either the extendable piston rod is secured to the base of the lift device and the hydraulic cylinder is secured to the lift car, or the piston rod is secured to the lift car, and the hydraulic cylinder is secured to the base of the lift device. The second end of the cable may be anchored to a point along the hydraulic cylinder.

While the rail is preferably mounted to the lift car, the rail can alternatively be secured to a relatively fixed point on the lift (e.g., along the base), and the anchor point could be secured to the movable lift car. In either case, the elongated flexible member, or cable, includes a first portion extending generally between the actuator and the second end of the rail, generally parallel to the rail, and a second portion extending generally between the second end of the rail and the anchor point. This second portion of the cable preferably extends at a substantial angle relative to the rail.

A first proximity sensor is adjustably mounted to the rail; this first proximity sensor generates an electrical signal when it detects that the actuator is proximate thereto. The position at which the first proximity sensor is mounted to the rail can be varied, relative to the second end of the rail, in order to adjust the maximum elevational height of the lift car. The first proximity sensor is preferably an electrical switch that is mechanically engaged by the actuator as the actuator advances toward the second end of the rail. For example, the electrical switch may includes a lever arm with a roller on one end thereof; during elevation of the lift car, the roller is engaged by the actuator as the actuator advances toward the second end of the rail, thereby tripping the lever arm of the switch. In this case, the electrical signal generated by the proximity sensor may simply be an open circuit (or alternatively, the creation of a closed circuit). Other types of proximity sensors, including those that do not rely upon physical engagement, may also be used.

The lifting mechanism of the lift device preferably operates under the direction of control circuitry. When the first proximity sensor is tripped by the presence of the actuator, the control circuitry halts any further elevation of the lift car. Assuming that the position of the first proximity sensor has been properly adjusted along the rail, the floor of the lift car is now properly aligned with the stage, platform, or the like.

Preferably, a second proximity sensor is mounted to the rail between the first end of the rail and the first proximity sensor. The second proximity sensor detects that the actuator is proximate thereto, and generates a corresponding electrical signal to indicate that the lift car has been elevated to some intermediate height lower than the maximum elevated height. Ideally, this second proximity sensor is used to indicate that the lift car has been raised more than one or two inches above the ground.

DETAILED DESCRIPTION OF THE PREFERRED EMBODIMENTS

Figure 1:
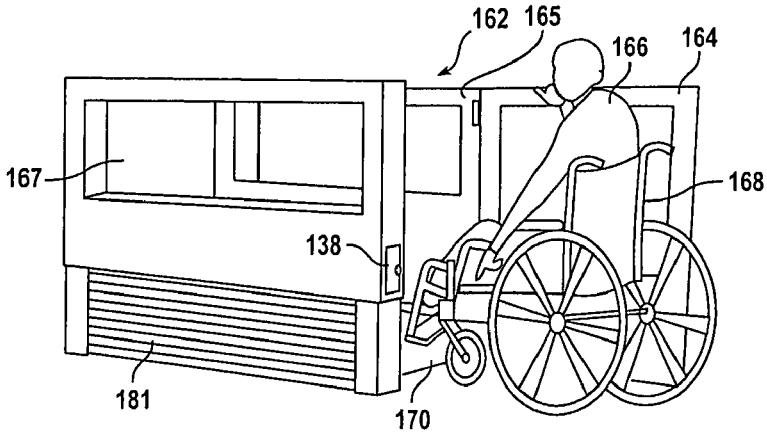
FIG. 1 shows a user entering the lift car from the ground.

In FIG. 1, a lift device includes a movable lift car 162, as well as a lifting mechanism (not shown) that selectively elevates lift car 162 relative to the ground from a lowered position to an elevated position. In FIG. 1, lift car 162 is shown completely lowered to the floor, and a front (lower landing) gate 164 has been opened for allowing user 166 to roll his wheelchair 168 onto the floor 170 of lift car 162 from ground level. Lift car 162 includes opposing side panels 165 and 167. Lower landing gate (or front entry gate) 164 preferably includes an electro-mechanical interlock that prevents front entry gate 164 from being opened whenever lift car 162 is more than two inches above the fully lowered position. In addition, a safety skirt 181 completely encloses and protects the area under lift car 162.

Figure 2:
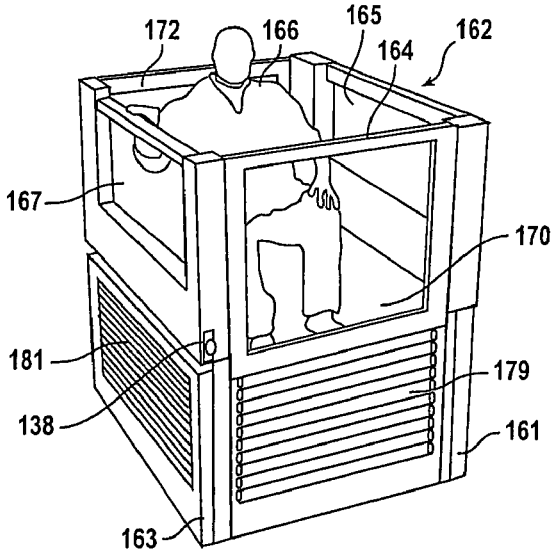
FIG. 2 shows a user being lifted in the lift car.

In FIG. 2, user 166 is being elevated in lift car 162 toward stage height. Front gate 164, and rear (stage) gate 172, are both closed and secured during elevation. For safety reasons, both the lower entry gate 164 and upper stage gate 172 are preferably self-closing.

Figure 3:
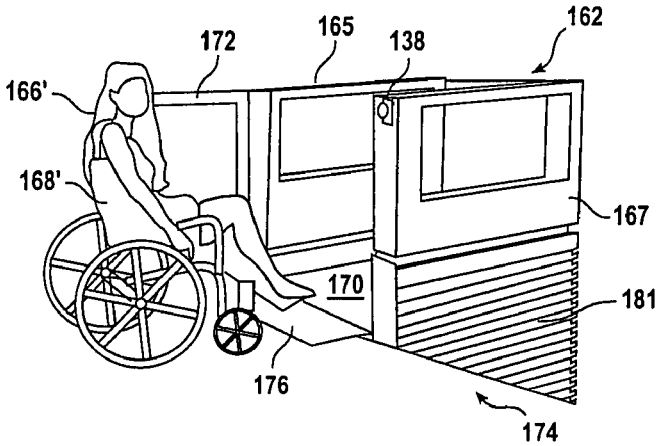
FIG. 3 shows a user entering the lift car from the stage through the stage gate.

FIG. 3 shows another user 166', already supported on stage floor 174, entering into lift car 162. Rear stage gate 172 is opened, and a hinged stage docking plate 176 is lowered to allow wheelchair 168' to roll smoothly onto lift car floor 170. As stage gate 172 opens, hinged dock plate 176 is automatically lowered into position by a tether (not shown), thereby spanning any small gap between lift car floor 170 and stage 174. Dock plate 176 rests on stage 174 and provides a smooth transition between lift car floor 170 and stage 174. When stage gate 172 is closed, dock plate 176 is simultaneously retracted by the aforementioned tether.

Figure 4:
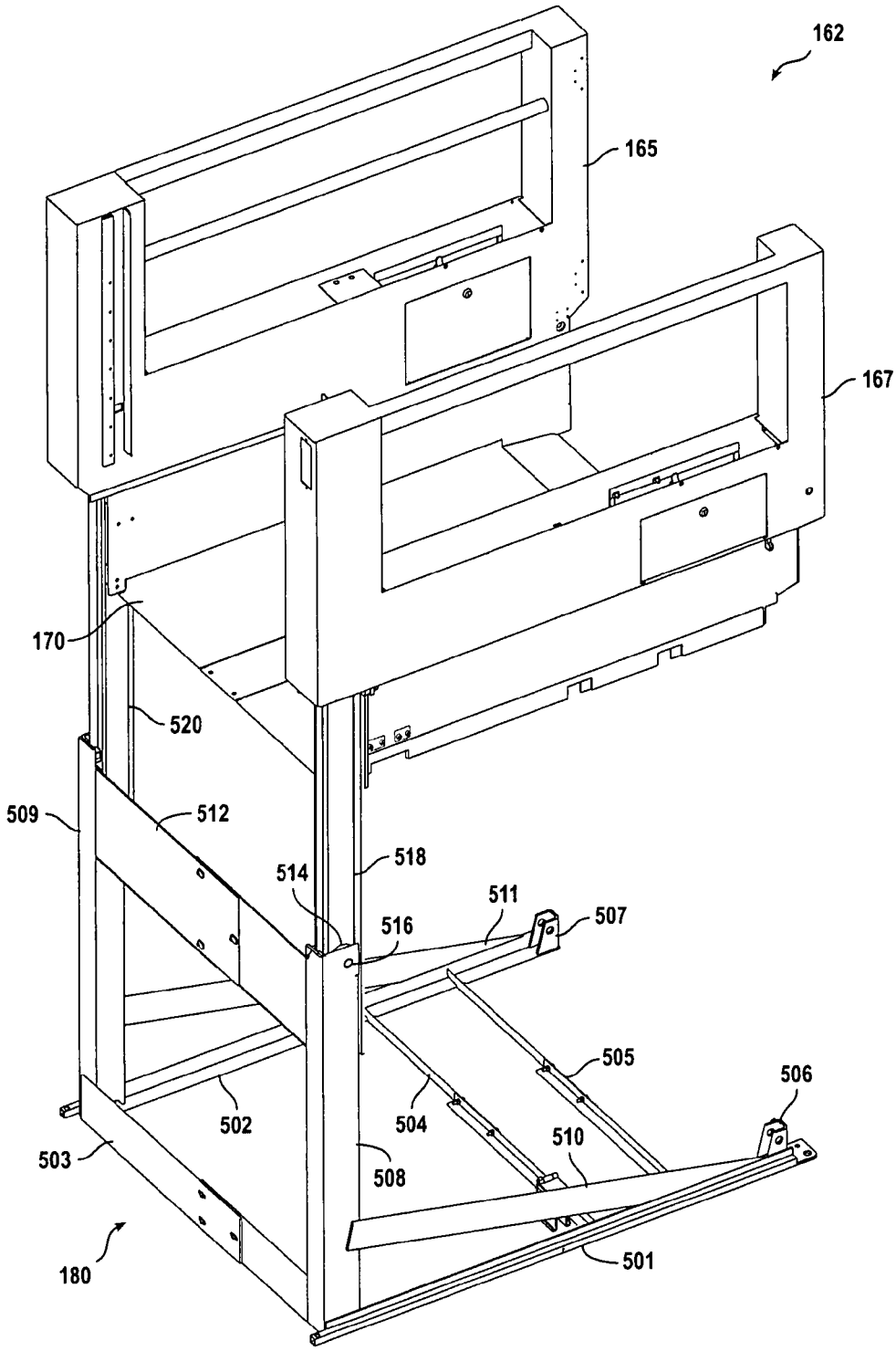
FIG. 4 is a perspective, skeletal view of the lift device base, intermediate support rails, and lift car in an elevated position.

FIG. 4 shows the base, intermediate lift support rails, and lift car skeleton used to fabricate the lift device. The hydraulic lifting cylinders, motor, hydraulic pump, and protective skirt, are omitted from FIG. 4 for purposes of clarity. Base 180 includes a pair of opposing, parallel elongated metallic members 501 and 502 that are coupled to each other by cross-braces 503, 504 and 505. Brackets 501 and 502 each include apertured brackets 506 and 507, respectively, for receiving piston rods of the hydraulic lifting cylinders. A pair of U-shaped rails 508 and 509 project upwardly from metallic members 506 and 507, respectively. Angled braces 510 and 511 are welded to rails 508 and 509, respectively, and to the opposing ends of metallic members 501 and 502, respectively. Cross brace 512 extends between, and couples, the upper ends of rails 508 and 509. Partially visible in FIG. 4 is a roller 514 which pivots upon axle 516 near the upper end of rail 508. A similar roller (not shown) is installed at the upper end of rail 509.

Still referring to FIG. 4, a pair of intermediate lift support rails 518 and 520 are slidingly supported by rails 508 and 509, respectively, for vertical movement. The aforementioned sliding support of rail 518 is provided by roller 514, and by a lower roller (not visible) secured by an axle to the lower end of intermediate rail 518; this lower roller engages the inner U-shaped walls of rail 508. Lift car 162 is, in turn, slidingly supported by intermediate lift support rails 518 and 520. Lift car 162 includes floor 170 extending between opposing side panels 165 and 167. Again, for purposes of clarity, the front and rear gate entry doors (164 and 172 in FIGS. 1-3) have been removed for clarity. The upper ends of intermediate lift support rails 518 and 520 are slidingly received within side panels 167 and 165, respectively. While not visible within FIG. 4, rollers secured to the upper ends of intermediate lift support rails 518 and 520, and rollers secured within side panels 167 and 165, allow the upper ends of intermediate lift support rails 518 and 520 to telescope within, or extend from, the bottoms of side panels 167 and 165.

Figure 5:
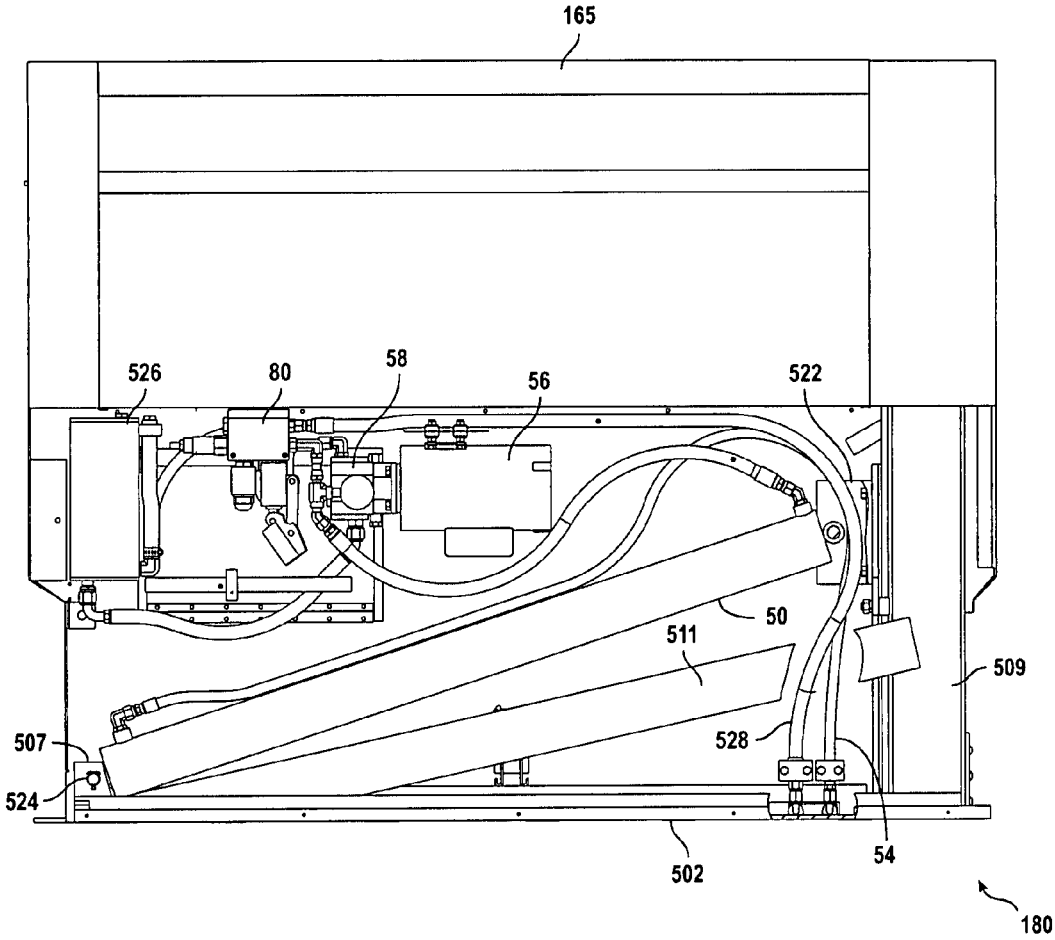
FIG. 5 is a cut-away side view of the lift device showing the position of an electric motor, hydraulic pump, hand-operated manual pump, and one of the hydraulic cylinders used to raise the lift car.

FIG. 5 is a side view of the lift device in its lowered position, with the protective skirt and a portion of the side panel cut away for clarity. In addition, the springs and sensors used to detect deformation of the protective skirt have also been omitted from FIG. 5 for clarity. Hydraulic lifting cylinder 50 has its upper end secured to bracket 522 of lift car side panel 165 for selectively raising lift car 162. The piston rod extending from the lower end of hydraulic lifting cylinder 50 is connected by pin 524 to apertured bracket 507 of base 180. Also visible within FIG. 5 are electric motor 56, rotary pump 58, manual pump 80 (used in the event of an electrical power failure), hydraulic fluid reservoir 526 and hydraulic solenoid valve 68. With the exception of hydraulic cylinder 50, all of the aforementioned components fit within side panel 165 of lift car 162. Lines 528 and 54 pass below base 180 to the opposite side of the lift device for powering the second hydraulic lift cylinder.

Figure 6:
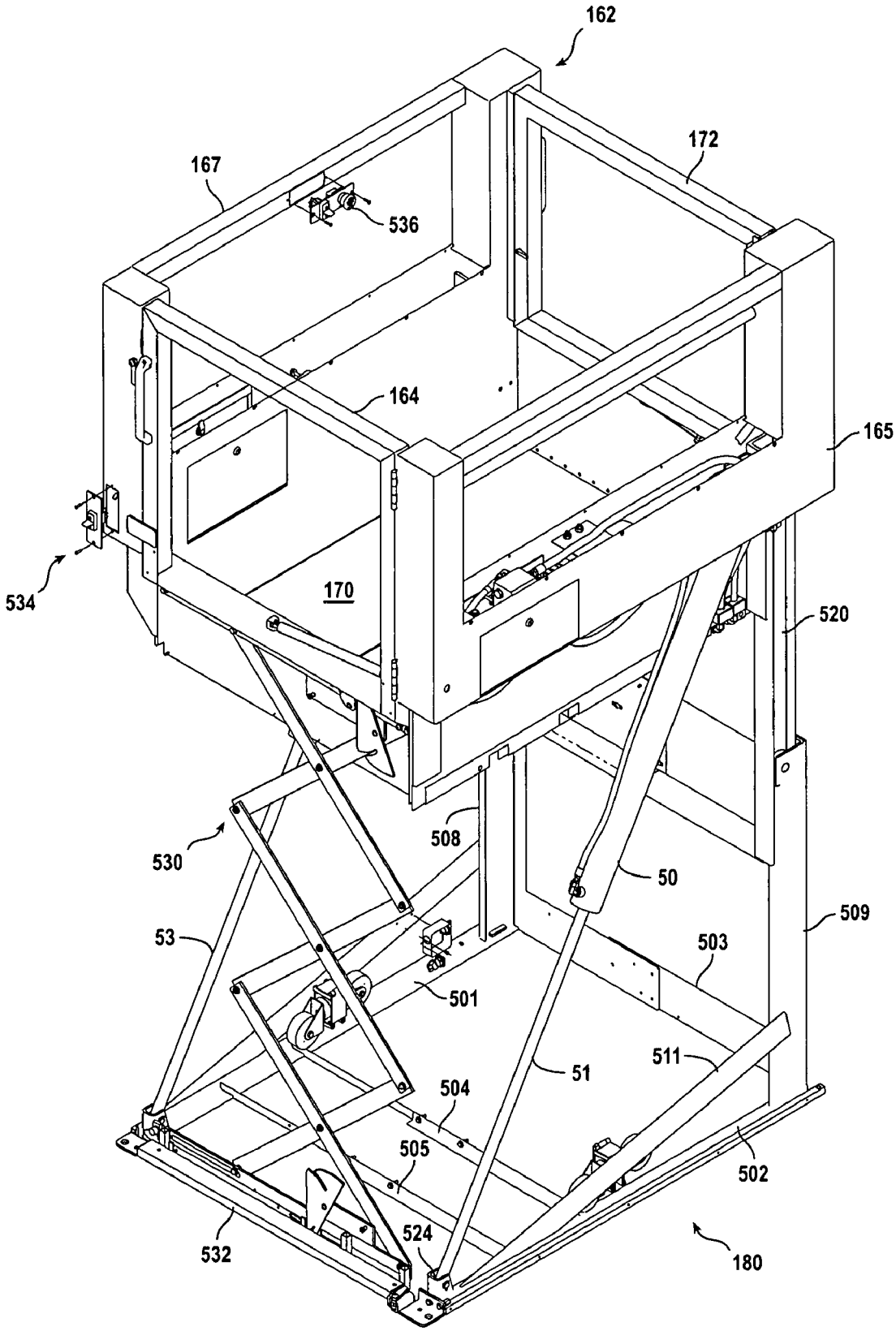
FIG. 6 is another perspective, skeletal view of the lift device, similar to FIG. 4, but adding the hydraulic lift cylinders, lift car gates, and front gate scissors interlock.

FIG. 6 is a perspective view similar to that shown in FIG. 4, but rotated 180 degrees, and now including the hydraulic lift cylinders 50 and 52, front gate 164, and rear gate 172. Once again, the protective skirt, skirt tension springs, and skirt sensors are omitted from this view for purposes of clarity. Front lift gate 164 includes a stabilizing scissors brace 530 that expands and contracts as lift car 162 is raised and lowered. Scissors brace 530 helps to stabilize lift car 162 when elevated. The lowermost links of scissors brace 530 are coupled to a lower support bar 532, which is allowed to swivels outward, along with entry gate 164, when lift car 162 is fully-lowered. Piston rods 51 and 53 are shown fully extended in FIG. 6. Switch assemblies 534 and 536 are also shown for operating the lift device from outside, or inside, lift car 162, respectively. The lift car 162, base support frame 180, and the hydraulic lifting cylinders 50/52 are all preferably formed from ASTM A36, AISI 1018, or AISI 1020 Steel. All transparent windows incorporated within lift car side panels 165 and 167, and within the front and rear gates 164 and 172 are preferably fabricated from ¼" thick high impact strength clear thermoplastic material.

Figure 7:
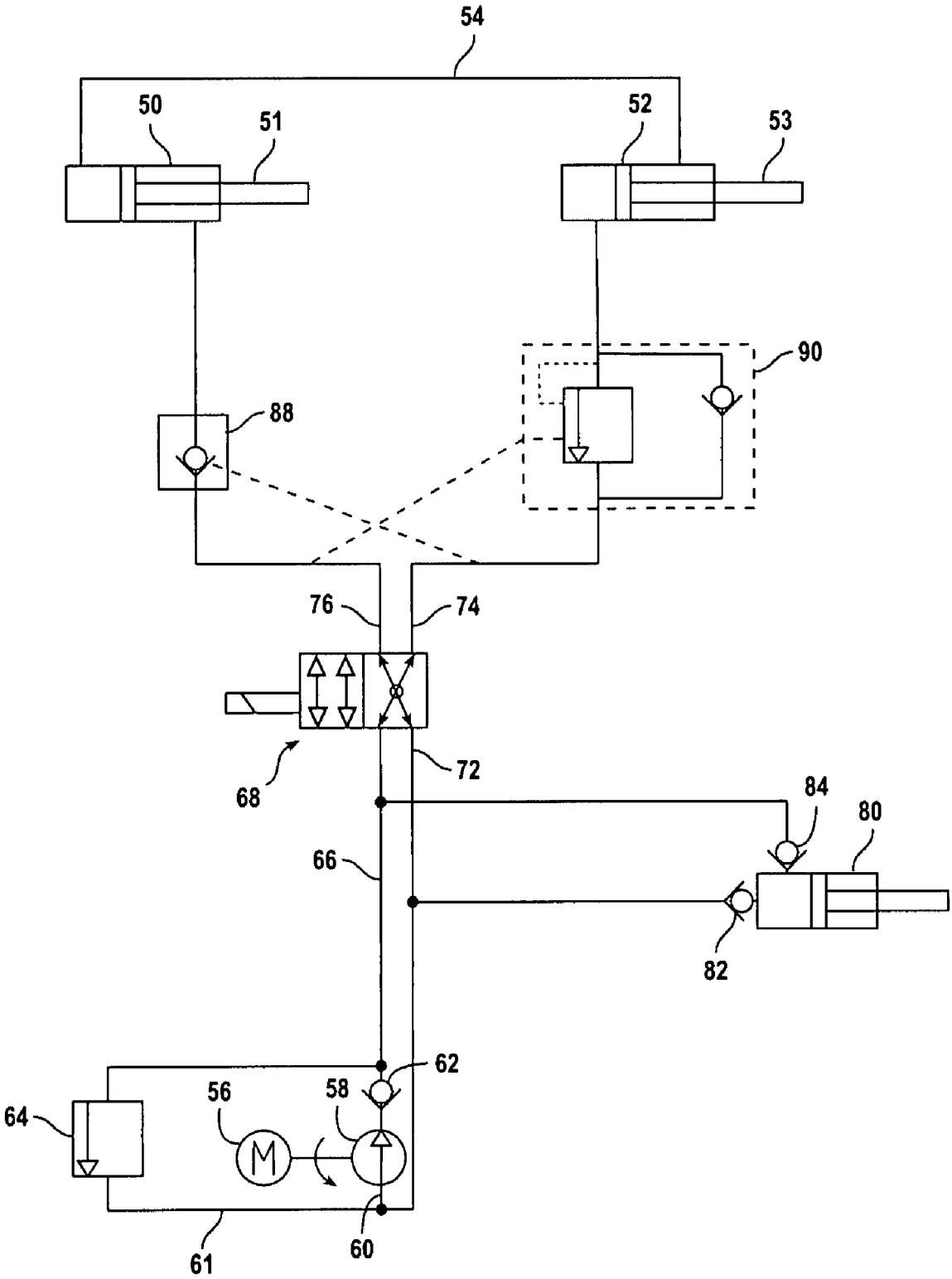
FIG. 7 is a schematic drawing of the hydraulic lifting mechanism, including an electric motor, hydraulic gear pump, supplemental hand pump, control valves, and hydraulic cylinders.

FIG. 7 is a schematic diagram of a hydraulic control system that may be used to control the wheel chair lift device in one preferred embodiment. A pair of hydraulic lifting cylinders, including left side cylinder 50 and right side cylinder 52, are provided to raise and lower the wheel chair lift. In this preferred embodiment, hydraulic cylinders 50 and 52 are of the type generally available from Ram Industries Inc., a Canadian company having a U.S. distribution facility in Minot, N. Dak. Left side cylinder 50 is preferably of the type available from Ram Industries Inc. as Model No. R4505901 (3000 psi operating pressure, 2.5" bore, 40.5" stroke, 1.125" rod), while right side cylinder 52 is preferably a Model No. R4505902 (3000 psi operating pressure, 2.75" bore, 40.5" stroke, 1.125" rod). Cylinders 50 and 52 each include an expansion chamber and a retraction chamber. The expansion chamber of cylinder 50 is coupled by tube 54 to the retraction chamber of cylinder 52. When the lift is being raised, pressurized hydraulic fluid is forced into the expansion chamber of cylinder 52, extending piston rod 53, compressing fluid in the retraction chamber of cylinder 52, and forcing the compressed fluid into the expansion chamber of cylinder 50 for extending piston rod 51. Alternatively, when the lift is being lowered, pressurized hydraulic fluid is forced into the retraction chamber of cylinder 50, retracting piston rod 51, compressing fluid in the expansion chamber of cylinder 50, and forcing the compressed fluid through tube 54 into the retraction chamber of cylinder 52 for retracting piston rod 53.

Still referring to FIG. 7, electric motor 56 rotates in a fixed direction to rotate the input drive shaft of hydraulic fluid pump 58. In the preferred embodiment, motor 56 is a one-half horsepower, 120 V AC electric pump motor of the type commercially available from Leeson Electric Corporation of Grafton, Wis. Pump 58 is preferably a close-coupled, hydraulic gear pump of the type commercially available from JS Barnes Corp./Haldex Hydraulics Corporation of Rockford, Ill. under Part No. G1112H1A109NPG, having a cubic displacement of 0.194 cubic inches. Pump 58 draws hydraulic fluid from inlet 60 via fluid return line 61 and pumps hydraulic fluid out under pressure through check valve 62. Relief valve 64 is provided as part of pump 58 and can be adjusted to permit a selected amount of pressurized hydraulic fluid to be directed back to fluid return line 61.

Still referring to FIG. 7, hydraulic fluid pressurized by pump 58 is supplied via high pressure conduit 66 to the high pressure inlet of a solenoid valve 68. Solenoid valve 68 also includes a low pressure outlet coupled to return conduit 72 for coupling to fluid return line 61. Solenoid valve 68 is normally biased (by a spring) to a position for raising cylinders 50 and 52. In this case, solenoid valve 68 assumes the default crossed-over position shown in FIG. 7, wherein high pressure inlet line 66 is coupled to line 74, and low pressure outlet 72 is coupled to line 76. Preferably, solenoid valve 68 is a 12 VDC solenoid valve with manual override of the type commercially available from Hydac Technology Corporation, Hydraulics Division, of Glendale Heights, Ill., under Part Number WK08Y-01-M-C-N, with electrical coil Part Number 12 DS-40-1836.

In the event of a power failure, motor 56 that powers hydraulic pump 58 will no longer operate. For this reason, hydraulic hand pump 80 is provided in an emergency to raise and lower the lift car without electrical power. Still referring to FIG. 7, hand-operated fluid pump 80 includes a fluid inlet coupled through a check valve 82 to low pressure return line 72 for receiving unpressurized hydraulic fluid. Pump 80 also includes a high-pressure outlet port for supplying pressurized hydraulic fluid through check valve 84 to high pressure line 66. A lever can be reciprocated by an operator to raise or lower the lift using such hand-operated pump 80 if motor 56 is suddenly lacking any electrical power. Pump 80 is preferably of the type available from HydraForce, Inc. of Lincolnshire, Ill. under part number HP10-21B-0-N-B.

As shown in FIG. 7, pilot-operated check valve 88 couples line 76 to the retraction chamber of hydraulic cylinder 50. Valve 88 is preferably of the type commercially available from Hydac Technology Corporation, Hydraulics Division, of Glendale Heights, Ill., under Part Number RP08A-01C-NS-15-4. Line 74 is coupled by an over-center, counter-balance, spring-biased valve 90 to the expansion chamber of cylinder 52. Valve 90 is preferably of the type commercially available from Hydac Technology Corporation, Hydraulics Division, of Glendale Heights, Ill., under Part Number RS08-01-C-N-4-500V. Valve 90 is adjustable to help ensure that cylinders 50 and 52 expand and retract at the same rate.

Figure 8:
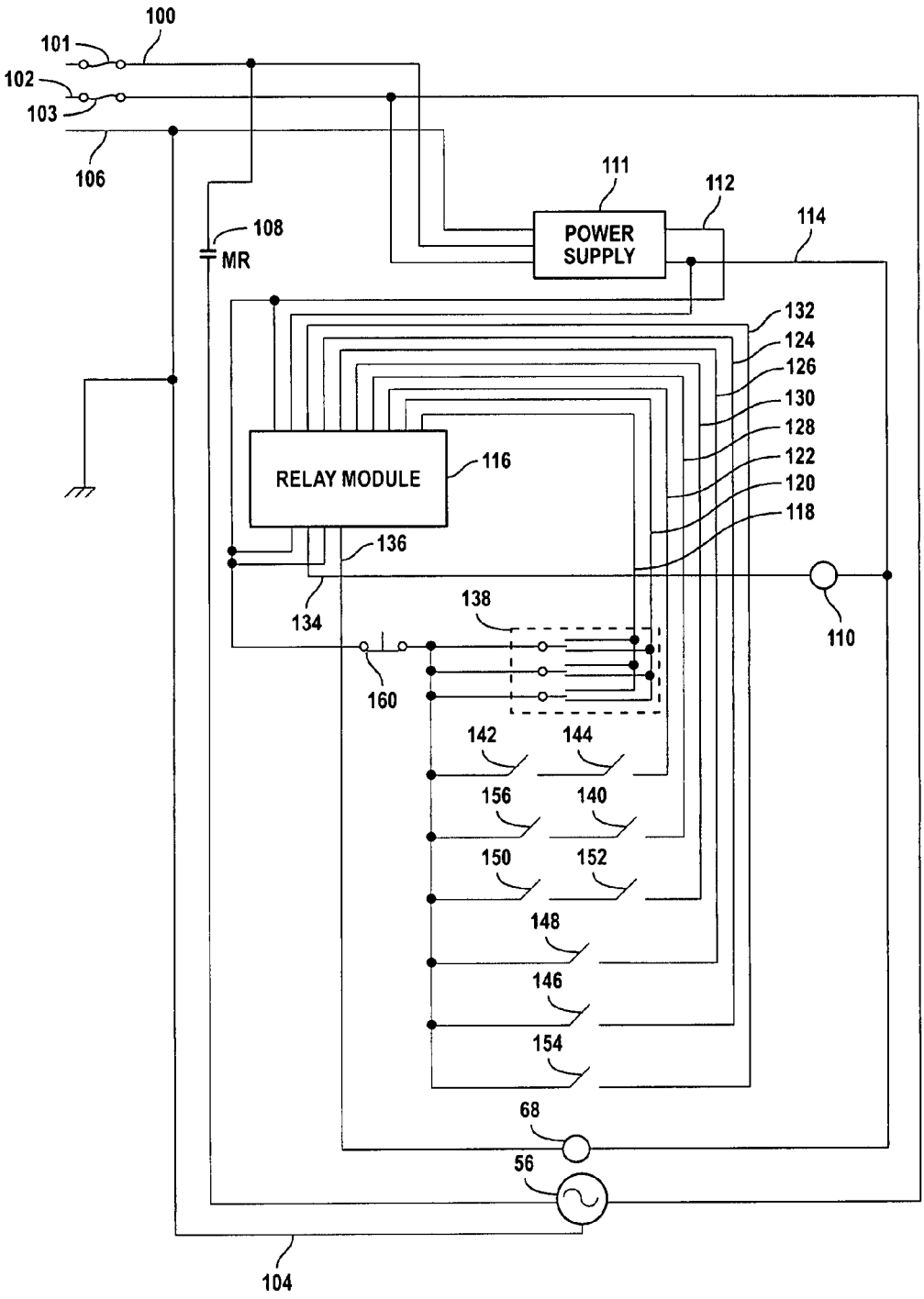
FIG. 8 is an electrical circuit schematic illustrating the switches and control circuitry for controlling the operation of the motor and solenoid valve that power the hydraulic lifting mechanism.

The electrical schematic of FIG. 8 includes pump motor 56 electrically coupled across 110 Volt power lines 100 and 102, protected by fuses 101 and 103, respectively. The housing of motor 56 is coupled by ground line 104 to ground conductor 106. Element 108 is coupled in series between motor 56 and "hot" power line 100 and represents the contacts of motor relay 110 (also shown in FIG. 8) that selectively applies power to motor 56. The 110 Volt service lines 100 and 102, and ground conductor 106, are also coupled to a regulated 12 Volt D.C. power supply 111. Power supply 111 provides a source of a regulated 12 volt D.C. voltage on line 112 relative to low-power ground line 114.

The heart of the control system for controlling the lift is an IDEC Smart Relay module 116 commercially available from IDEC Izumi Corporation of Sunnyvale, Calif. under part number FL1C. This module is a compact, expandable, fully programmable, CPU that can replace multiple timers, counters, and relays. As indicated in FIG. 8, module 116 is coupled to 12 volt D.C. power lines 112 and 114. Module 116 includes a series of input terminals coupled to conductors designated by reference numerals 118, 120, 122, 124, 126, 128, 130 and 132. Module 116 also includes output terminals 134 and 136.

Input terminal 118 is the "UP" terminal; when a "high" voltage is applied to input 118, module 116 is signaled to raise the lift. Input terminal 120 is the "DOWN" terminal; when a high voltage is applied to input 120, module 116 is signaled to lower the lift. As will be described in greater detail below, there are three toggle switches (grouped together in FIG. 8 within dashed box 138) positioned about lift car 162 for selecting upward or downward movement of the lift car.

Input terminal 122 is coupled in series with two right-side skirt sensor switches 142 and 144, described in greater detail below. Switches 142 and 144 detect deflection of the protective skirt on the right side of the lift device. Switches 142 and 144 are normally closed to apply a "high level" on conductor 122. If either switch 142 or switch 142 is opened due to deflection of the protective skirt, then movement of lift car 162 (upward or downward) ceases.

Similarly, input terminal 128 is coupled in series with two left-side skirt sensor switches 156 and 140, described in greater detail below. Switches 156 and 140 detect deflection of the protective skirt on the left side of the lift device. Switches 156 and 140 are normally closed to apply a "high level" on conductor 128. If either switch 156 or switch 140 is opened due to deflection of the protective skirt, then movement of lift car 162 (upward or downward) ceases.

Input terminal 124 is the "2 Inch Switch" terminal and is coupled to "2 Inch Switch" 146. When lift car 162 is being raised from the ground, the electrical contacts of switch 146 are closed as the floor of the lift car reaches approximately two inches above the ground. The 2 Inch Switch 146 signals, via input terminal 124, that the floor of the lift car has raised to approximately two inches above the ground. One of the safety features provided in the preferred embodiment relates to ensuring that the front gate (164 in FIG. 6) of the lift car is securely locked closed once the floor of the lift car has raised two inches off of the ground. If the floor of the lift car has raised more than two inches off of the ground, but a front gate safety interlock bolt has not engaged, then further elevation of the lift car is prevented.

Input terminal 126 is the "Lockbolt" terminal and is used to signal that the front gate safety interlock bolt, briefly described in the preceding paragraph, is engaged. The electrical contacts of lockbolt switch 148 are closed when the interlock bolt is engaged, but such electrical contacts open if the interlock bolt is not engaged. As mentioned above, safe operation of the lift is ensured by confirming that the front gate safety interlock bolt has engaged, and hence, that the front gate (or lower landing gate) is securely locked, before allowing the lift car to elevate more than a few inches off of the ground.

Input terminal 130 is the "Landing Gate" terminal and is used to detect whether the front landing gate (i.e., front gate 164 in FIG. 6) and rear landing gate (i.e., rear gate 172 in FIG. 6, the gate providing access to an elevated stage) are closed. The electrical contacts of upper landing gate switch 150 open if the rear gate is open, and close when the rear gate is closed. Likewise, the electrical contacts of lower landing gate switch 152 open if the front gate is open, and close when the front gate is closed. When all gates are closed, switches 150 and 152 are closed, and a "high level" signal is conveyed to conductor 130, allowing lift car 162 to continue movement; if not, movement of the lift ceases.

Finally, input terminal 132 is the "Height" terminal and is used to signal whether or not the lift car has reached a pre-selected height. An electrical height switch 154 can be adjusted, in a manner to be described in greater detail below, to cause its electrical contacts to be open if the lift car is below a desired height, but to close such electrical contacts when the lift car reaches the pre-selected height, thereby signaling relay module 116 to prevent further elevation of lift car 162.

Still referring to FIG. 8, output terminal 134 is coupled to one side of solenoid valve 68, the other side of which is coupled to ground line 114. Module 116 provides a "low" voltage when it is desired to raise the lift, and provides a "high" (+12 V DC) voltage when it is desired to lower the lift. Referring briefly to FIG. 7, it can be seen that, depending upon the position of solenoid-controlled valve 68, the direction in which pressurized hydraulic fluid is directed into hydraulic cylinders 50 and 52 can be reversed by actuating solenoid valve 68.

As shown in FIG. 8, output terminal 136 of module 116 is coupled to one side of motor relay coil 110, the other side of which is coupled to ground line 114. When module 116 causes output terminal 136 to assume a "high" (+12 V DC) output state, motor relay coil 110 is energized, and the electrical contacts of motor relay 108 are closed to energize pump motor 56. As is also shown in FIG. 8, a normally-closed emergency stop button 160 may be positioned inside lift car 162 to shut down the operation of the lift during an emergency.

Figure 9:
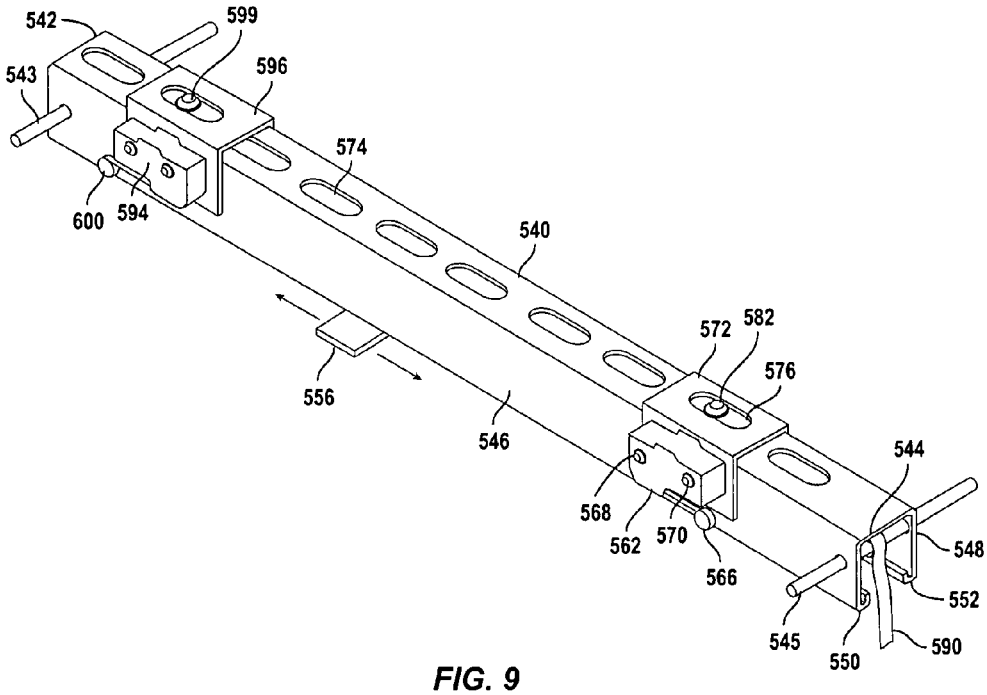
FIG. 9 is a perspective view of a height adjustment rail, viewed from above, used to set the predetermined height to which the lift device is elevated.
Figure 10:
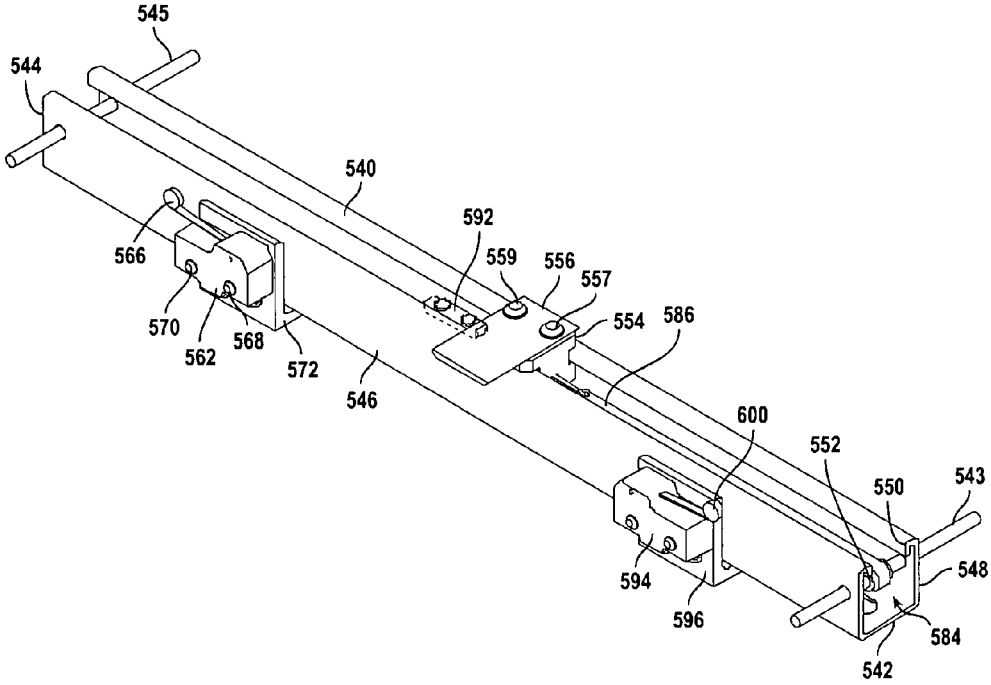
FIG. 10 is a perspective view of the height adjustment rail shown in FIG. 9 viewed from below.

Referring now to FIGS. 9 and 10, the preferred embodiment of the height adjustment mechanism, used to adjust the maximum height to which lift car 162 can be elevated, will now be described. A generally U-shaped, elongated rail 540 extends between first and second opposing ends 542 and 544. Rail 540 is preferably made of metal, and the lower edges of side walls 546 and 548 preferably turn back inwardly inside rail 540 to form two inwardly directed flanges 550 and 552, as best illustrated in the enlarged end view shown in FIG. 11. Mounting pins 543 and 545 extend transversely through the first and second ends 542 and 544, respectively, of rail 540.

Figure 12:
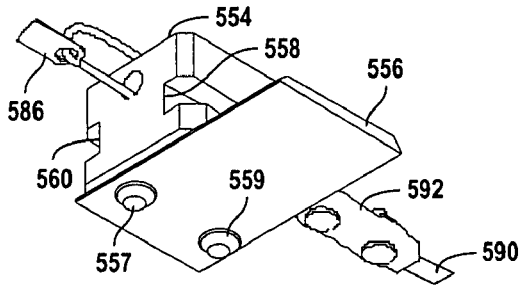
FIG. 12 is an enlarged view of the actuator that slides within the height adjustment rail.

An actuator 554 is slidingly received within rail 540, and a transverse tab 556 extends from actuator 554 below rail 540. The features of actuator 554 are best observed in the enlarged view of FIG. 12. Actuator 554 is preferably formed of plastic, and is ideally machined from Nylon material. As shown in FIG. 12, the side walls of actuator 554 have opposing slots 558 and 560 formed therein; these slots are slidingly engaged by inwardly directed flanges 550 and 552 of rail 540 for allowing actuator 554 to slide along rail 540 between the first end 542 and the second end 544 thereof, while being captured therein. Mounting pins 543 and 545 prevent actuator 554 from exiting from either end of rail 540. Transverse tab 556 is secured to the underside of plastic actuator body 554 by a pair of screws 557 and 559.

Figure 14:
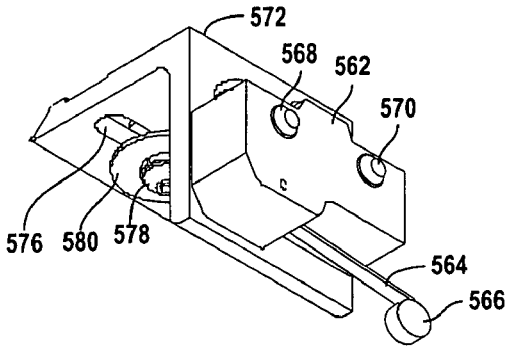
FIG. 14 is an enlarged view of the maximum height, upper-stop switch.

Still referring to FIGS. 9 and 10, a first proximity sensor, in the form of an electrical microswitch 562, is mounted on rail 540 generally closer to second end 544 of rail 540 than to first end 542. Switch 562 is preferably similar to those sold under Part No. BZ-2RW82-A2 by Honeywell Microswitch. Switch 562 corresponds to the upper stop switch 154 in the electrical schematic of FIG. 8. As shown in FIG. 14, switch 562 includes a lever arm 564 having a cam roller 566 at its distal end. Switch 562 is secured by a pair of screws 568 and 570 to a vertical wall of angle bracket 572. The upper horizontal wall of angle bracket 572 is adapted to engage the upper, horizontal central wall of rail 540.

As indicated in FIG. 9, a series of slots, including slot 574, are formed along the upper, horizontal central wall of rail 540. Alternatively, one long continuous slot could be formed in the upper, horizontal central wall of rail 540, if desired. Similarly, a slot 576 is formed in upper horizontal wall of angle bracket 572. As will be explained below, maximum elevation height of the lift car is adjusted by moving, and re-tightening, angle bracket 572 relative to rail 540. Referring to FIG. 14, a screw 578 extends through a lockwasher 580 from the underside of angle bracket 572, through slot 576. Turning to FIG. 9, the threaded tip of screw 578 is received within a mating lockwasher and nut (collectively designated by reference numeral 582). The length of slot 576, along with the lengths and spacings of slots 574, permit virtually infinite adjustment of the position of switch 562 along rail 540. During installation of the lift device, the installer adjusts the position of switch 562 along rail 540 to make the lift car stop so that the floor 170 of the lift car is even with the stage 174.

Figure 11:
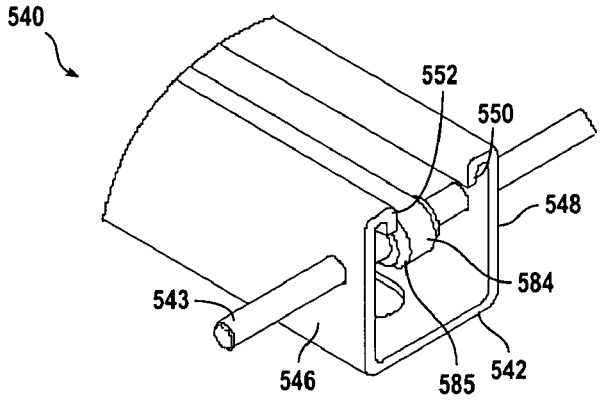
FIG. 11 is an enlarged view of the second end of the height adjustment rail.

Referring jointly to FIGS. 10, 11 and 12, a constant force spring 584 is wrapped about a plastic drum 585 for rotation about mounting pin 543. Constant force spring 584 is similar to the constant force springs often found within tape measures for causing the elongated tape to retract. The free end 586 of constant force spring 584 is coupled with actuator 554. Constant force spring 584 thereby serves as a biasing member for biasing actuator 554 toward first end 542 of rail 540, and away from second end 544 of rail 540. While this biasing force is preferably created by a constant force spring, the biasing force could alternatively be created using the force of gravity, as by attaching a weight, via a cable and pulley, to actuator 554, or by simply mounting rail 540 at an angle to the horizontal (with first end 542 being the lowermost point) and attaching a weight directly to actuator 554.

Actuator 554 is disposed generally proximate to first end 542 of rail 540 when lift car 162 is in its lowered position on the ground. A first end of a flexible cable 590 extends into rail 540 from second end 544 and is attached to actuator 554 by anchor 592. Cable 590 is preferably formed of braided wire of the type known as aircraft cable. As will be described in more detail below, as lift car 162 is elevated, cable 590 pulls on actuator 554 against the biasing force of spring 584, causing actuator 554 to slide toward second end 544 of rail 540, and toward switch 562. As actuator 554 nears switch 562, tab 556 engages cam roller 566 of lever arm 564, closing microswitch 562. The closing of switch 562 corresponds to the generation of an electrical signal that indicates that actuator 554 is proximate to switch 562, and that the maximum height of the lift car has been achieved. Relay module 116 (see FIG. 8) is responsive to this electrical signal for halting any further elevation of the lift car.

Figure 13:
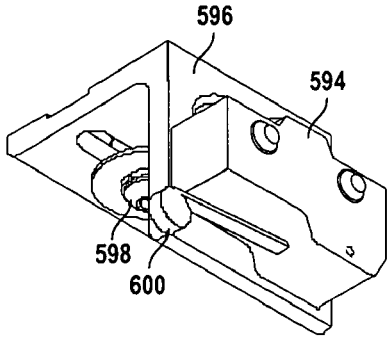
FIG. 13 is an enlarged view of the "two-inch" electrical switch.

It will be recalled that it is also desirable to generate a signal indicating that the lift car has been raised slightly above the ground, e.g., by two inches above the ground. This signal can easily be generated using the height adjustment rail and actuator already described above. Referring again to FIGS. 9 and 10, a second microswitch 594 is secured to a second angle bracket 596. Microswitch 594 may be of the same type used for switch 562. Second angle bracket 596 is adjustably mounted to rail 540 using a screw 598 and nut 599 in the same manner already described above for angle bracket 572. However, second angle bracket 596 is mounted proximate to first end 542 of rail 540, between first end 542 and switch 562. As lift car 162 begins to rise, the tab 556 of actuator 554 engages cam roller 600 (see FIG. 13) of switch 594, closing switch 594, and signaling that lift car 162 has left the ground. The exact position of switch 594 along rail 540 can be set, as desired, to trigger when the lift car 162 is a fixed number of inches above the ground.

Figure 15:
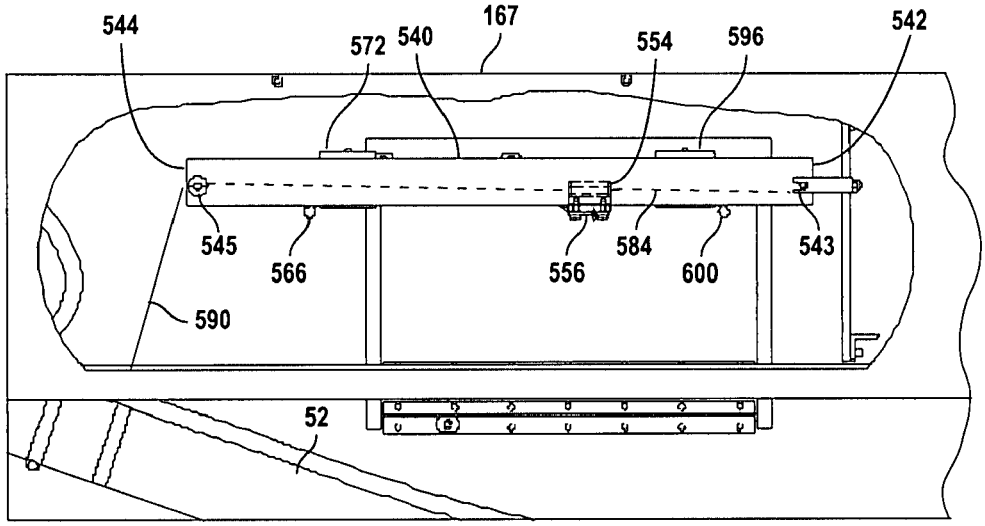
FIG. 15 is a side cut-away view of the height adjustment rail mounted within a side panel of the lift car.
Figure 16:
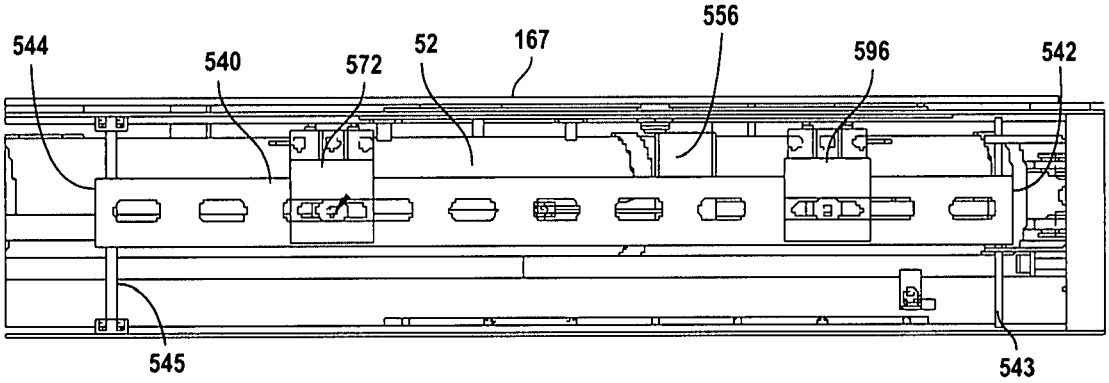
FIG. 16 is a top, cross-sectional view of the structure shown in FIG. 15.

Turning to FIGS. 15 and 16, height adjustment rail 540 is shown after being mounted within side panel 167 of lift car 162, via mounting pins 543 and 545. As shown in FIG. 15, rail 540 is preferably mounted to extend substantially horizontally, and is secured to side panel 167 of the lift car; accordingly, as lift car 162 rises and falls, rail 540 rises and falls along with it. When lift car 162 is fully-lowered, actuator 554 (and its tab 556) are disposed all the way to the right, near the first end 542 of rail 540, and tab 556 does not yet engage cam roller 600. The first end of cable 590 is secured to actuator 554, and the second end of flexible cable 590 is coupled to an anchor point below the second end 544 of rail 540. This anchor point could be a point on base 180 of the lift. Alternatively, the anchor point can be a location on the lifting mechanism of the lift device, for example, a point on hydraulic lift cylinder 52. In that event, the second end of cable 590 can advantageously be anchored to hydraulic cylinder 52 by a hose clamp secured about the hydraulic cylinder; the second end of cable 590 is inserted inside the hose clamp, and the hose clamp is tightened.

As shown in FIG. 15, flexible cable 590 includes a first generally horizontal portion extending generally between actuator 554 and second end 544 of rail 540, generally parallel to rail 540. Flexible cable 590 also includes a second portion that extends generally between second end 544 of rail 540 and the anchor point; this second portion of flexible cable 590 extends at a substantial angle relative to rail 540. If desired, a pulley or roller can be provided on mounting pin 545 to guide cable 590 around the bend.

As lift car 162 elevates, cable 590 pulls actuator 554 from right to left (relative to FIGS. 15 and 16), first tripping cam roller 600 and later tripping cam roller 566 to halt further elevation. Once again, while rail 540 is preferably mounted horizontally, as shown in FIG. 15, it is possible to position rail 540 at an angle to the horizontal, or even vertically, in which case, actuator 554 could be biased away from second end 544 of rail 540 by the force of gravity, as by attaching a weight to actuator 554.

While rail 540 is preferably mounted to lift car 162, it is also possible to mount rail 540 to a fixed portion of the lift device (e.g., to a portion of base 180). In that event, the second end of flexible cable 590 should be attached to an anchor point above rail 540; this anchor point should be one that rises when lift car 162 is elevated, and that anchor point could be a point on the lift car itself.

Figure 17:
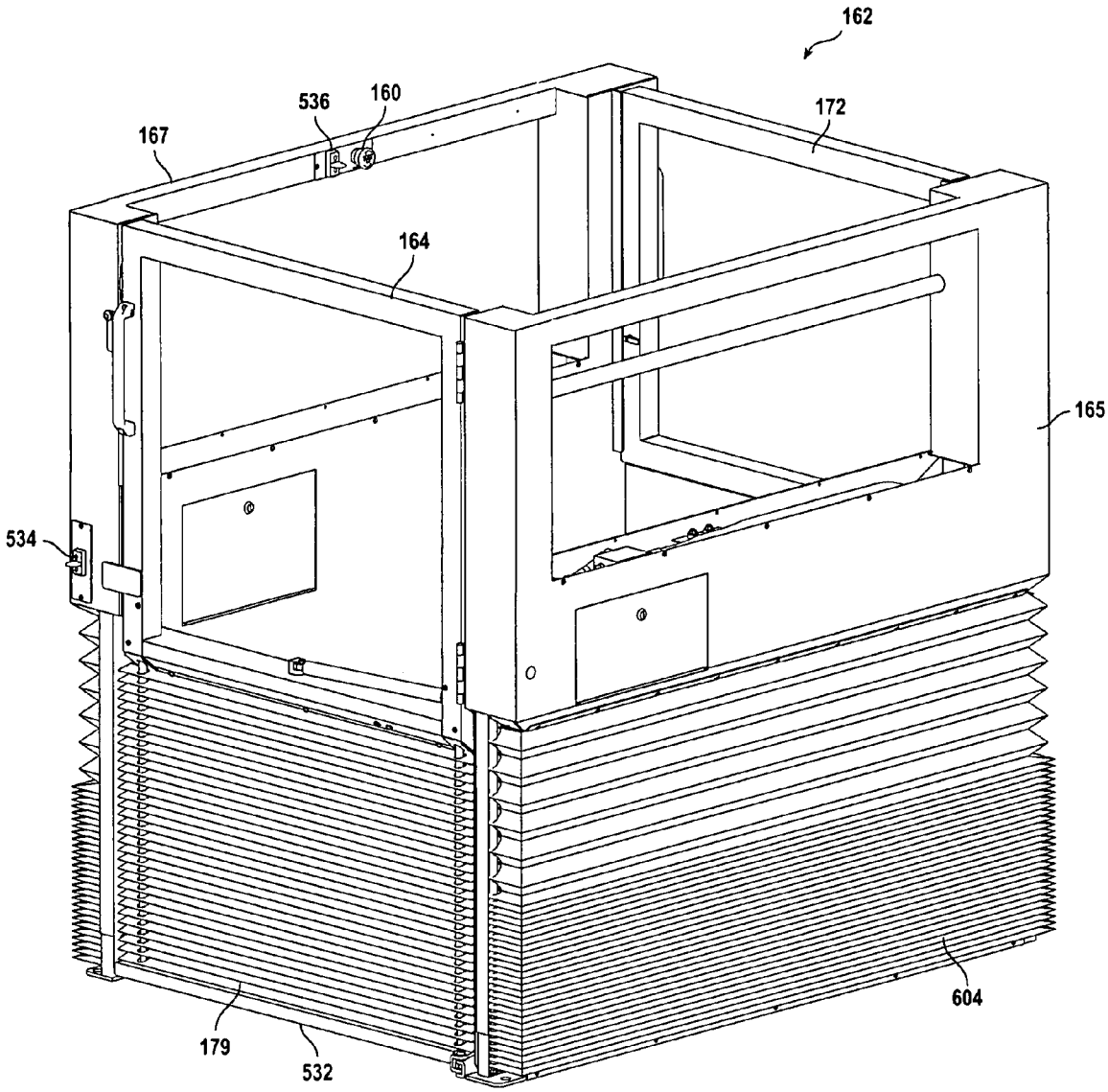
FIG. 17 is a perspective view of the lift device illustrating protective skirting installed thereon.
Figure 18:
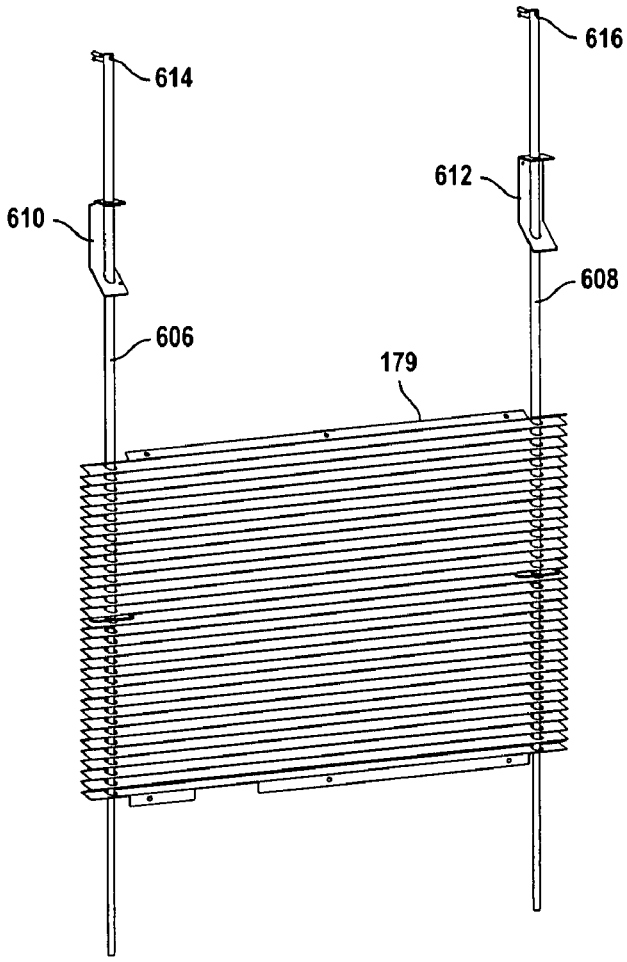
FIG. 18 is a perspective view of the protective skirt associated with the front gate of the lift car prior to assembly.

FIG. 17 shows the lift device partially elevated, and better illustrates the protective skirting that encircles the base of the lift device. As used herein, the term "collapsible curtain panel" is intended to include such protective skirting. Protective skirt 179 raises and collapses as front gate 164 of lift car 162 elevates and lowers, respectively. As shown in FIG. 18, protective skirt 179 consists of accordion-like flexible plastic pleated fabric; the pleats have vertically aligned holes formed near their opposing ends for slidingly receiving a pair of support rods 606 and 608. Mounting hardware 610, 612, 614 and 616 is used to secure the upper portions of support rods 606 and 608 within the opposing side frame members of front gate 164. The lower edge of skirt 179 is secured to lower support bar 532, and the upper edge of skirt 179 is secured to the lower frame member of front gate 164 for elevation therewith.

Referring briefly to FIG. 6, scissors brace 530 extends upwardly from lower support bar 532; scissors brace is hidden from view in FIG. 17, but extends just behind protective skirt 179. Scissors brace 530 is sufficiently rigid to support protective skirt against significant inward deformation; thus, even if a bystander leaned against, or fell against, protective skirt 179, there is little risk of injury to such person as a result of continued elevation, or continued lowering, of lift car 162.

At the opposite end of the lift device, below stage gate 172, there is also little risk of injury to others present because the lift device is typically permanently installed so that its rear side abuts a stage or other structure. Accordingly, persons would find it difficult to position themselves adjacent to the protective skirt 603 (see FIG. 19) that covers the rear side of the lift device below stage gate 172.

Figure 19:
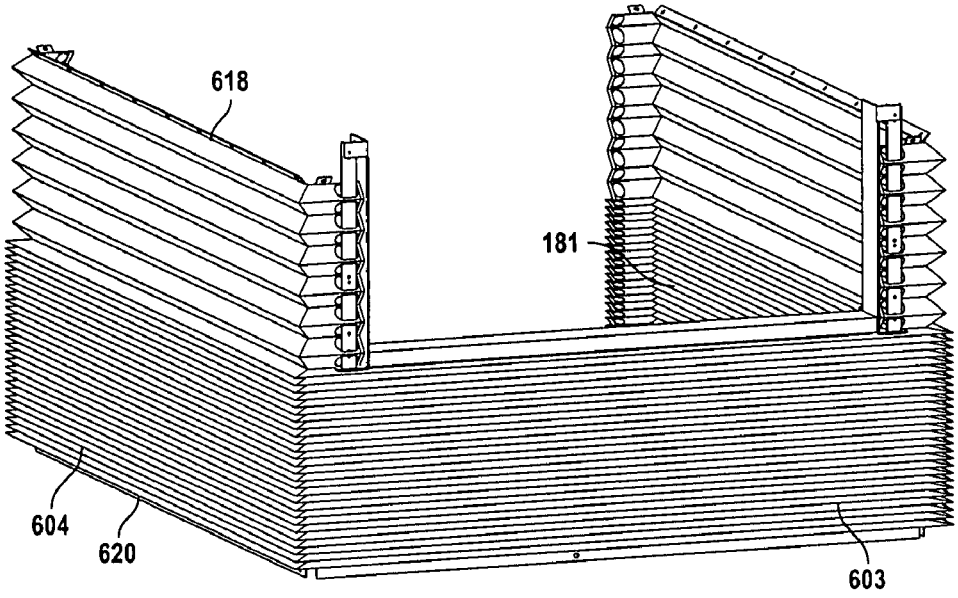
FIG. 19 is a perspective view of the protective skirt assembly that surrounds the sides and rear portion of the lift device.

Referring briefly to FIG. 19, it will be noted that the protective skirts that shield the rear portion, and two sides, of the lift device can be fabricated as a single structure, again preferably from accordion-like flexible plastic pleated fabric. Protective skirt 604 extends below side panel 165 of lift car 162, as shown in FIG. 17. Protective skirt 603 extends below the rear of lift car 162, and protective skirt 181 extends below side panel 167 of lift car 162, as shown in FIGS. 1-3. The upper end 618 of protective skirt 604 is secured to side panel 165 of lift car 162 for movement therewith, and the lower end 620 of protective skirt 604 is secured to base member 502.

Protective skirt 604 and opposing protective skirt 181 are both accessible to bystanders. While protective skirts 604 and 181 help to prevent arms and legs of bystanders from being poked under lift car 162, such protective skirts are necessarily flexible to facilitate expansion and retraction as lift car 162 is elevated and lowered. In view of such flexibility, protective skirts 604 and 181 will yield to significant inward pressure, as when a person leans against, or falls against, one of such skirts. A person's body could subsequently become pinched between the lower portion of lift car 162 and the ground if the lift car continued down toward the ground. It is therefore advisable to halt any further movement of lift car 162 if either protective skirt 604 or protective skirt 181 is inwardly deformed.

To prevent further lift car movement when either protective skirt 604 or protective skirt 181 is inwardly deformed, a series of skirt sensors are provided along the opposing sides of the lift device, as will now be described with reference to FIGS. 20 and 21. For clarity, protective skirt 604 is omitted from FIGS. 20 and 21. A first deformable elongated, elastic tension spring 630 has a first end 632 engaged with an anchor loop 634 on apertured bracket 507 near base 180. Second end 636 of elongated spring is secured to a hook or loop 638 anchored to an upper portion of hydraulic lift cylinder 50 by circular hose clamp 640, generally proximate lift car 162 for movement therewith. Spring 630 extends along hydraulic cylinder 50 facing, and adjacent to, protective skirt 604. As hydraulic cylinder 50 extends its piston rod to raise lift car 162, spring 630 stretches and elongates, but the longitudinal axis of spring 630 always extends generally across, and proximate to, protective skirt 604. If protective skirt 604 were deformed inwardly, as by someone falling against it, and applying a lateral force thereto, the contact between protective skirt 604 and spring 630 also laterally displaces spring 630.

Figure 20:
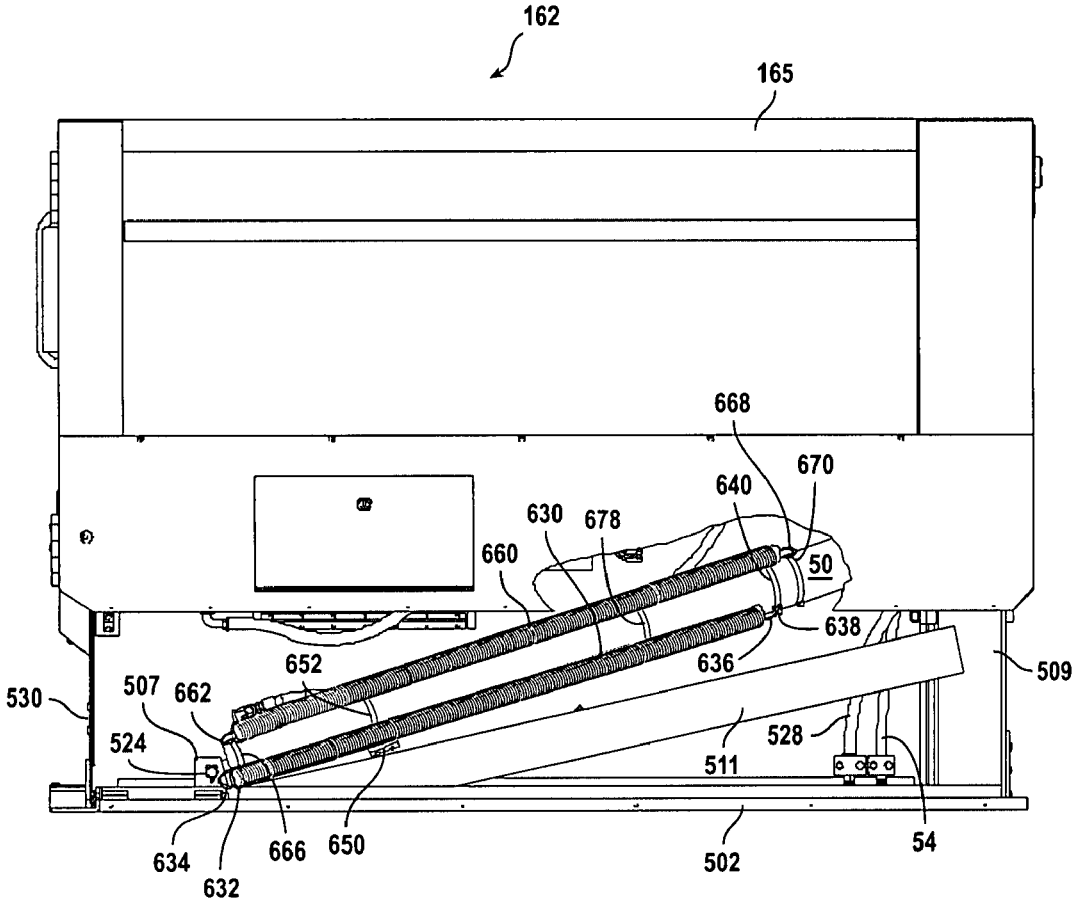
FIG. 20 is a side view of the lower portion of the lift device showing a pair of skirt sensors.
Figure 21:
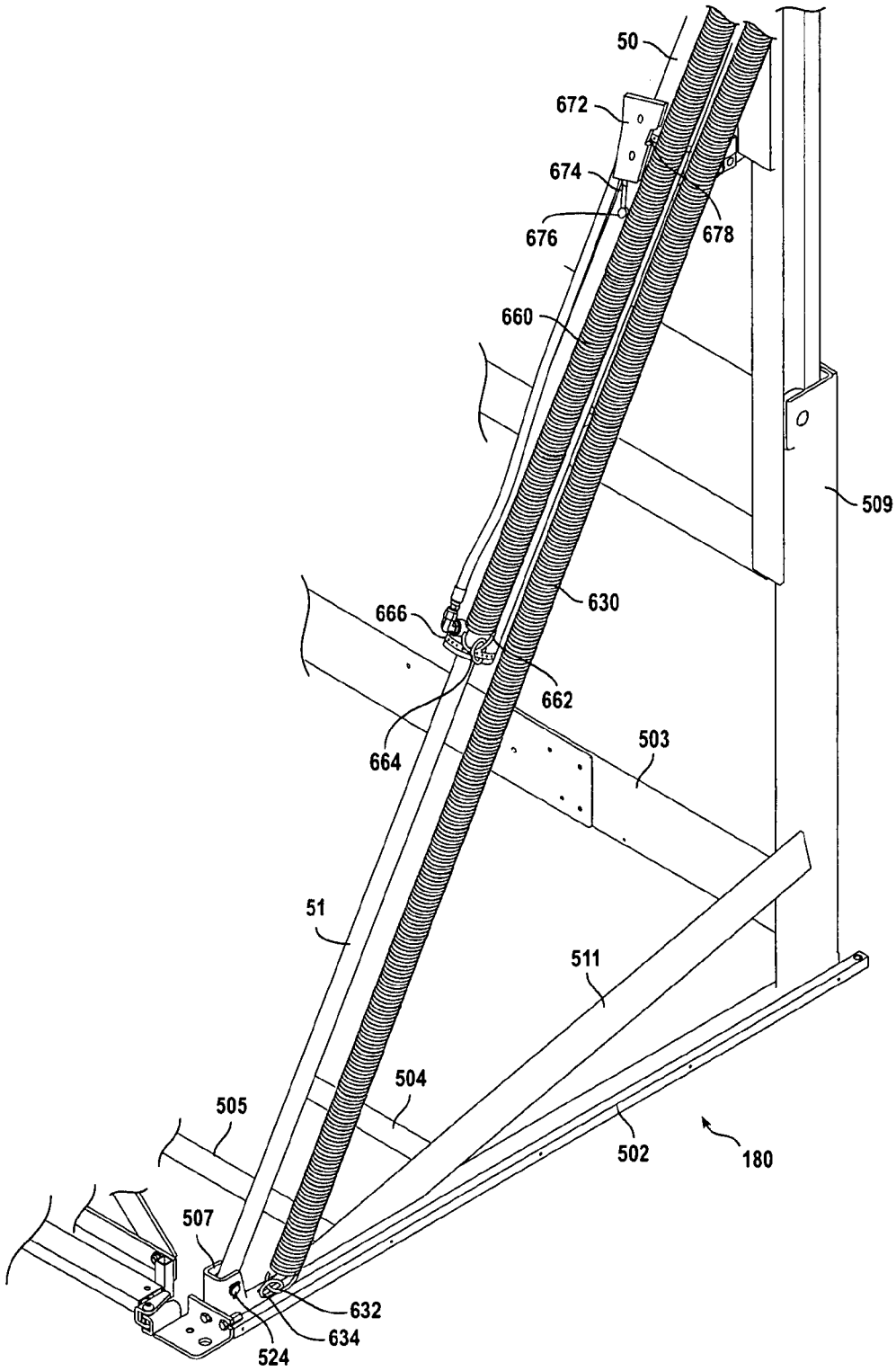
FIG. 21 is a perspective cut-away view of skirt sensor components shown in FIG. 20.

In FIG. 20, a microswitch 650 is mounted to hydraulic cylinder 50 by hose clamp 652. Microswitch 650 is similar to those described above for use with the height adjustment mechanism; preferably skirt sensor switch 650 is a Model No. BZ-2RW8299-A2 from Honeywell Microswitch, including an adjustable pre-travel feature. Microswitch 650 corresponds to one of the skirt sensor switches 142, 144, 156, and 140 described above in conjunction with the electrical schematic of FIG. 8. Switch 650 is normally "closed" to form an electrical short circuit. The cam roller on the lever arm of switch 650 is positioned just behind spring 630; as a result, any significant lateral deformation of tension spring 630, away from its longitudinal axis, causes switch 650 to "open", breaking the electrical path.

For added protection, a second tension spring 660 is also secured along hydraulic cylinder 50. Tension spring 660 has a first end secured to a hook or loop mounted to the lower end of hydraulic cylinder 50 by hose clamp 666. The upper end 668 of spring 660 is secured to an upper portion of hydraulic cylinder 50 by hose clamp 670. As shown in FIG. 21, another microswitch 672, similar to switch 650, and including lever arm 674 and cam roller 676, is mounted to hydraulic cylinder 50 by hose clamp 678. Cam roller 676 is disposed just behind spring 660 to detect any lateral deflection thereof caused by deformation of protective skirt 604. When cam roller 676 of switch 672 is contacted by spring 660, switch 672 opens. As explained above in conjunction with FIG. 8, when any of the skirt sensor switches open, relay module 116 immediately halts any further movement of lift car 162 until the problem is resolved.

Those skilled in the art will now appreciate that a height adjustment mechanism for a lift device has been described that is suitable for lifting wheelchair-bound users up to the height of stages and the like in a safe, reliable and repeatable manner. The elevational height of the lift car is easily adjusted during installation to proper stage height, thereafter permitting the lift car to be repeatably elevated to the same pre-set lift height, while comporting with all applicable ADA requirements. The disclosed height control mechanism is fully self-contained, and does not require any physical contact between the lift device and the stage. The disclosed height control mechanism is ideally suited for a permanently-installed wheelchair lift that remains permanently at a particular location, and which reliably raises the lift platform to the same desired height on a regular basis. The installer can adjust the height to which the lift is elevated quickly and easily during initial installation, and further adjustments should not be required. Moreover, the disclosed height control mechanism is easily adapted to detect whether the lift platform is more than one or two inches above the ground.

While the present invention has been described with respect to a preferred embodiment thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A height adjustment mechanism for a lift device, the lift device including a base, a movable lift car, and a lifting mechanism that selectively elevates the lift car relative to the base from a lowered position to an elevated position, the height adjustment mechanism serving to adjust the maximum height to which the lift car can be elevated, the height adjustment mechanism comprising in combination:

a) a rail that extends between first and second opposing ends, the rail being secured to the lift car, and the rail being elevated and lowered in accordance with raising and lowering of the lift car;

b) an actuator supported for movement along the rail generally between the first and second ends thereof, the actuator being disposed generally proximate to the first end of the rail when the lift car is in its lowered position, the actuator being biased away from the second end of the rail;

c) an elongated flexible cable having first and second ends, the first end of such cable being coupled to the actuator, and the second end of the cable being coupled to an anchor point, the cable urging the actuator toward the second end of the rail as the lift car is elevated; and d) a first proximity sensor adjustably mounted to the rail, the first proximity sensor detecting that the actuator is proximate thereto, and generating an electrical signal indicative thereof;

e) the lifting mechanism of the lift device being responsive to the electrical signal generated by the first proximity sensor for halting any further elevation of the lift car when the actuator is proximate to the first proximity sensor.

2. The height adjustment mechanism as recited in claim 1 wherein the cable is a braided wire cable.

3. A height adjustment mechanism for a lift device, the lift device including a base, a movable lift car, and a lifting mechanism that selectively elevates the lift car relative to the base from a lowered position to an elevated position, the lifting mechanism including a lift cylinder, the lift cylinder including a hydraulic cylinder and an extendable piston rod, the height adjustment mechanism sewing to adjust the maximum height to which the lift car can be elevated, the height adjustment mechanism comprising in combination:

a) a rail that extends between first and second opposing ends, the rail being secured to the lift car, and the rail being elevated and lowered in accordance with raising and lowering of the lift car;

b) an actuator supported for movement along the rail generally between the first and second ends thereof, the actuator being disposed generally proximate to the first end of the rail when the lift car is in its lowered position, the actuator being biased away from the second end of the rail;

c) an elongated flexible member having first and second ends, the first end of such flexible member being coupled to the actuator, the second end of the flexible member being anchored to the hydraulic cylinder, the flexible member urging the actuator toward the second end of the rail as the lift car is elevated; and d) a first proximity sensor adjustably mounted to the rail, the first proximity sensor detecting that the actuator is proximate thereto, and generating an electrical signal indicative thereof;

e) the lifting mechanism of the lift device being responsive to the electrical signal generated by the first proximity sensor for halting any further elevation of the lift car when the actuator is proximate to the first proximity sensor.

4. The height adjustment mechanism as recited in claim 3 wherein the piston rod is secured to the base of the lift device, and wherein the hydraulic cylinder is secured to the lift car.

5. A height adjustment mechanism for a lift device, the lift device including a base, a movable lift car, and a lifting mechanism that selectively elevates the lift car relative to the base from a lowered position to an elevated position, the height adjustment mechanism serving to adjust the maximum height to which the lift car can be elevated, the height adjustment mechanism comprising in combination:

a) a rail that extends between first and second opposing ends;

b) an actuator supported for movement along the rail generally between the first and second ends thereof, the actuator being disposed generally proximate to the first end of the rail when the lift car is in its lowered position, the actuator being biased away from the second end of the rail;

c) an elongated flexible member having first and second ends, the first end of such flexible member being coupled to the actuator, and the second end of the flexible member being coupled to an anchor point, the flexible member urging the actuator toward the second end of the rail as the lift car is elevated;

d) a first proximity sensor adjustably mounted to the rail, the first proximity sensor detecting that the actuator is proximate thereto, and generating an electrical signal indicative thereof, the lifting mechanism of the lift device being responsive to the electrical signal generated by the first proximity sensor for halting any further elevation of the lift car when the actuator is proximate to the first proximity sensor; and e) a second proximity sensor mounted to the rail between the first end of the rail and the first proximity sensor, the second proximity sensor detecting that the actuator is proximate thereto, and generating an electrical signal indicating that the lift car has been elevated to an intermediate height, the intermediate height being less than the maximum elevated height.

* * * * *